US006352472B1

(12) United States Patent
Tsuchida et al.

(10) Patent No.: US 6,352,472 B1
(45) Date of Patent: Mar. 5, 2002

(54) COIN EJECTION GUIDE STRUCTURE

(75) Inventors: Tamotsu Tsuchida; Takashi Inozuka, both of Saitama (JP)

(73) Assignee: Asahi Seiko Co., Ltd., Tokyo (JP)

( * ) Notice: Subject to any disclaimer, the term of this patent is extended or adjusted under 35 U.S.C. 154(b) by 22 days.

(21) Appl. No.: 09/589,856

(22) Filed: Jun. 8, 2000

(30) Foreign Application Priority Data

Jun. 9, 1999 (JP) ..... 11-197929

(51) Int. Cl.[7] ..... G07D 1/00
(52) U.S. Cl. ..... 453/50
(58) Field of Search ..... 453/50, 48, 53; 221/226, 235

(56) References Cited

U.S. PATENT DOCUMENTS

| | | | | |
|---|---|---|---|---|
| 4,518,001 A | | 5/1985 | Branham | 133/5 R |
| 5,122,094 A | | 6/1992 | Abe | 453/57 |
| 5,810,655 A | * | 9/1998 | Suzukawa et al. | 453/50 |
| 5,924,919 A | * | 7/1999 | Hirano | 453/57 |
| 6,021,884 A | | 2/2000 | Tsuchida | 194/335 |
| 6,039,643 A | | 3/2000 | Kurosawa et al. | 453/3 |
| 6,059,651 A | * | 5/2000 | Abe et al. | 453/50 |
| 6,261,170 B1 | * | 7/2001 | Bell et al. | 453/57 |

FOREIGN PATENT DOCUMENTS

| | | | |
|---|---|---|---|
| JP | 7-112054 | 7/1995 | A63F/5/04 |
| JP | 9319908 | 12/1997 | G07D/1/00 |

* cited by examiner

*Primary Examiner*—Donald P. Walsh
*Assistant Examiner*—Mark J Beauchaine
(74) *Attorney, Agent, or Firm*—Price and Gess

(57) ABSTRACT

A coin dispensing apparatus of a compact design for dispensing coins at high speed from a storage hopper includes a selection mechanism for selecting the coins from the hopper and passing the coins along a passageway to an exit opening. A coin ejection guide assembly is positioned adjacent the exit opening and includes a movable member that is spring biased to contact the coin. A contact member is positioned opposite the movable member at a predetermined distance for forcing the coin to push against the movable member. A guide unit is located downstream of the movable member for changing the direction of movement of the coin after it is pushed against the movable member. The guide unit can include a rotatable guide roller and a sloping guide rail. The movable member can further exert the storage spring energy as an ejection force against the rear edge of the coin to propel it through the exit opening in the direction determined by the guide unit.

12 Claims, 6 Drawing Sheets

COIN EJECTION GUIDE STRUCTURE

BACKGROUND OF THE INVENTION

1. Field of the Invention

The present invention is directed to an improvement in a coin dispensing apparatus and more particularly to a coin ejection guiding mechanism of a compact configuration for efficiently directing coins that are dispensed at high speed from a coin supply hopper.

2. Description of Related Art

A large number of different coin dispensing apparatus have been proposed to address the requirements of vending machines, gaming machines, arcade machines, change dispensing machines, etc. When a significant number of coins, tokens, medallions, or other dispensed coin-like objects are ejected from a storage hopper within the dispensing apparatus, there has been a constant desire to increase the speed of dispensing of the coins in a safe and efficient manner. Referring for example to FIGS. 3 and 4, a prior art coin dispenser such as shown in U.S. Pat. No. 5,122,094 is disclosed. A coin supply hopper 1 is mounted on a base plate 11 which is positioned at about 60° to a horizontal surface by the supporting frame 10. A coin feeding rotary disc 2 is rotatably supported on the inclined base plate 11 within the coin supply hopper 1 through a central rotary shaft 12.

The coin feeding rotary disc 2 has a disc body 3 with a circumferential wall 4 to provide a pan like shape. The disc body 3 is provided with a plurality of circumferentially spaced coin receiving through holes 5 which can, for example, hold five coins in each hole. The inner surface 4*b* of the wall 4 carries a plurality of coin agitating protrusions 6 at positions between the coin receiving holes. The coin agitating protrusions 6 are inwardly inclined from the top end 4*a* to the lower end of the circumferential wall 4. The coin supply hopper 1 has a cylindrical lower portion 22 which is fixed to the inclined base plate 11 around the coin feeding rotary disc 2 and is further provided with a coin outlet 23 open at the downstream side of a coin outlet guide portion 17 for an elliptical coin guide plate 15. A circular stage 14 has a thickness slightly larger than the thickness of a coin to be dispensed. The coin feeding rotary disc 2 is rotatably supported on the circular stage 14 whereby one coin will drop from a coin receiving through hole on the coin supporting surface of the base plate 11 between the coin feeding arms 13. The guiding elliptical plate 15 is positioned around the circular stage 14 and a large diameter end portion has a central hole 16. The large diameter end portion and the small diameter end portion have a pin 18 and a pin 19, respectively, projecting from the surface of the guide plate 15 on the side of the inclined base plate 11. The inclined base plate 11 is provided with a plurality of pin holes 20*a*, 20*b* . . . , 21*a*, 21*b* which are spaced apart to receive the pins 18 and 19, respectively. Thus, the elliptical coin guide plate 15 can be selectively set to change the position of the guide portion 17 in correspondence to a diameter of a coin to be treated between a small coin guide position defined by the pin holes 20*a* and 21*a*, respectively and a large coin guide position defined by the pin holes 20*b* and 21*b*, respectively.

At the upstream side of the coin outlet 23, a fixed guide roller 24 is rotatably supported on a roller shaft 25 fixed to the base plate 11 and at the downstream side of the coin outlet 23, a movable guide roller 26 is rotatably supported on a roller shaft 27 secured to a rockable actuator 28 of an outlet sensor. The outlet sensor actuator 28 is pivotally secured to a bracket 29 by a pivot pin 30 fixed to the base plate 11. The roller shaft 27 of the moveable guide roller 26 is extended through an arched groove 31 formed in the base plate 11. A coin counting sensor 32 is secured to the bracket 27 so that it is operated by the actuator 28 which is pushed against a spring force through the moveable guide roller 26 by a coin passing through coin outlet 23.

An occasional problem occurs in releasing coins into the oblique upper part of the structure shown in FIGS. 3 and 4 in that such equipment cannot be compactly designed to meet all the requirements in coin dispensing equipment where space must be conserved. In other words, when a coin dispensing hopper, such as shown in FIGS. 3 and 4, is installed into a coin dispensing apparatus, sufficient space must be provided to accommodate the functional arrangement of its constituent parts.

Another example of prior art is found in the Japanese Laid Open Application No. 7-112054 which attempts to provide a coin directing mechanism that would prevent conflict between succeeding coins that are ejected.

The prior art is still seeking improvements in the ejection of coins from coin dispensing apparatus to meet the demands of compact designs for modern usage.

SUMMARY OF THE INVENTION

This invention provides a coin ejection guide assembly that can be mounted in a coin dispensing apparatus for the high speed dispensing of a coin from a plurality of stored coins, for example, in a storage hopper. A coin is removed from the storage hopper and individually directed along a passageway to a coin ejection or exit opening. The coin ejection guide assembly is mounted adjacent the exit opening of the coin dispensing apparatus and can include a movable member for contacting the exiting coin. A spring member can bias the movable member against passage of the coin with the movable member being a rotatable roller with a shaft journaled within an elongated camming opening. A relatively fixed contact member is positioned opposite the movable member and can be a rotatable roller that is positioned at a predetermined distance for insuring that the ejected coin is pushed against the movable member as it passes between the contact member and the movable member. A guide unit is located downstream of a movable member for contacting the ejected coin and changing its direction of movement from its initial contact against the movable member. Additionally, the spring energy that is stored when the movable member is pushed against the spring member can thereafter be applied as an injection force by further contact of the movable member with a rear edge of the coin so that it is propelled through the exit opening in the changed direction. The guide unit can further include a guide roller that is positioned at the end of a sloping guide rail to provide further control and direction to the ejected coin.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the coin dispensing art to make and use the invention and sets forth the best modes contemplated by the inventors of carrying out their invention. Various modifications, however, will remain readily apparent to those skilled in the art.

The reference numbers utilized on the drawings have been generically utilized to refer to similar component parts throughout the respective drawings.

The present invention utilizes the terminology "coin" in a broad sense to include not only monetary coins which usually are of a cylindrically configuration, but also medallions, tokens, disks and other objects that are frequently utilized and dispensed from vending machines, gaming machines, arcade machines and other dispensing apparatus such as subway tokens, admission coins for arcade use, gaming machines, etc.

The contents of U.S. Pat. No. 5,122,094 is hereby incorporated by reference as if set forth in its' entirety.

Figure 1A:
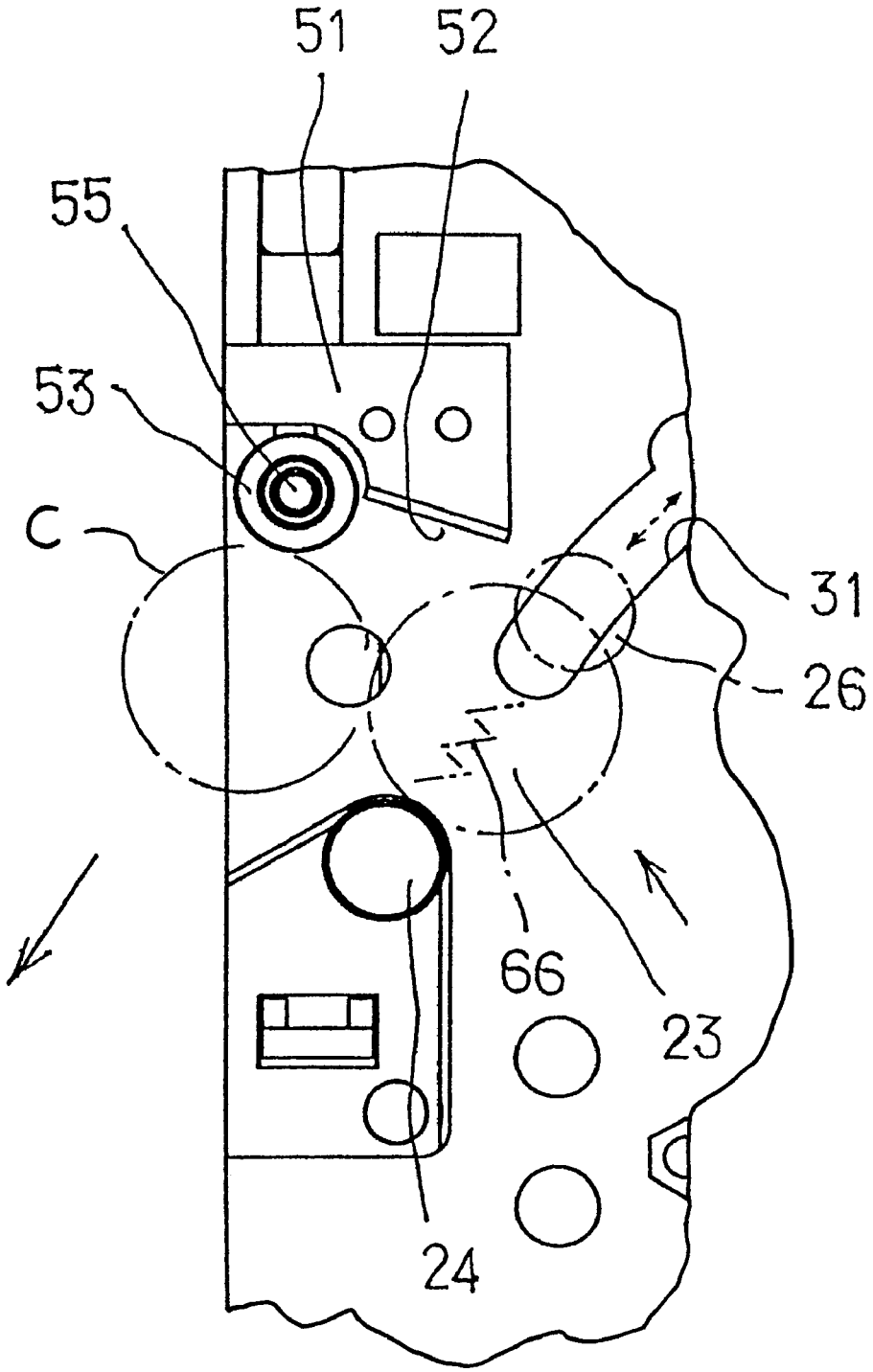
FIG. 1*a* is a partial side elevational view of the coin ejection mechanism of the present invention.
Figure 1B:
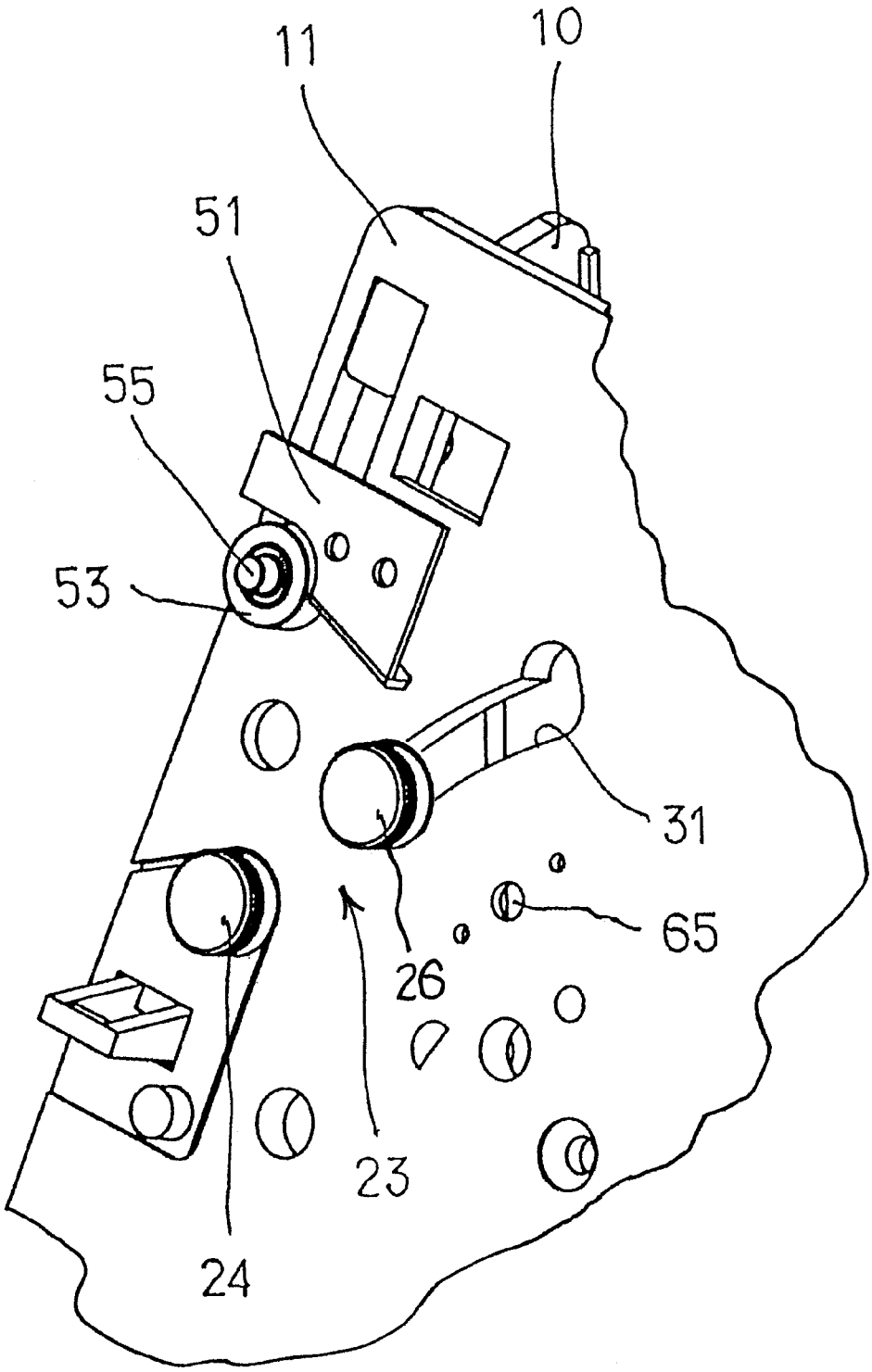
FIG. 1*b* is a partial prospective view of the coin ejection mechanism of the present invention.
Figure 2A:
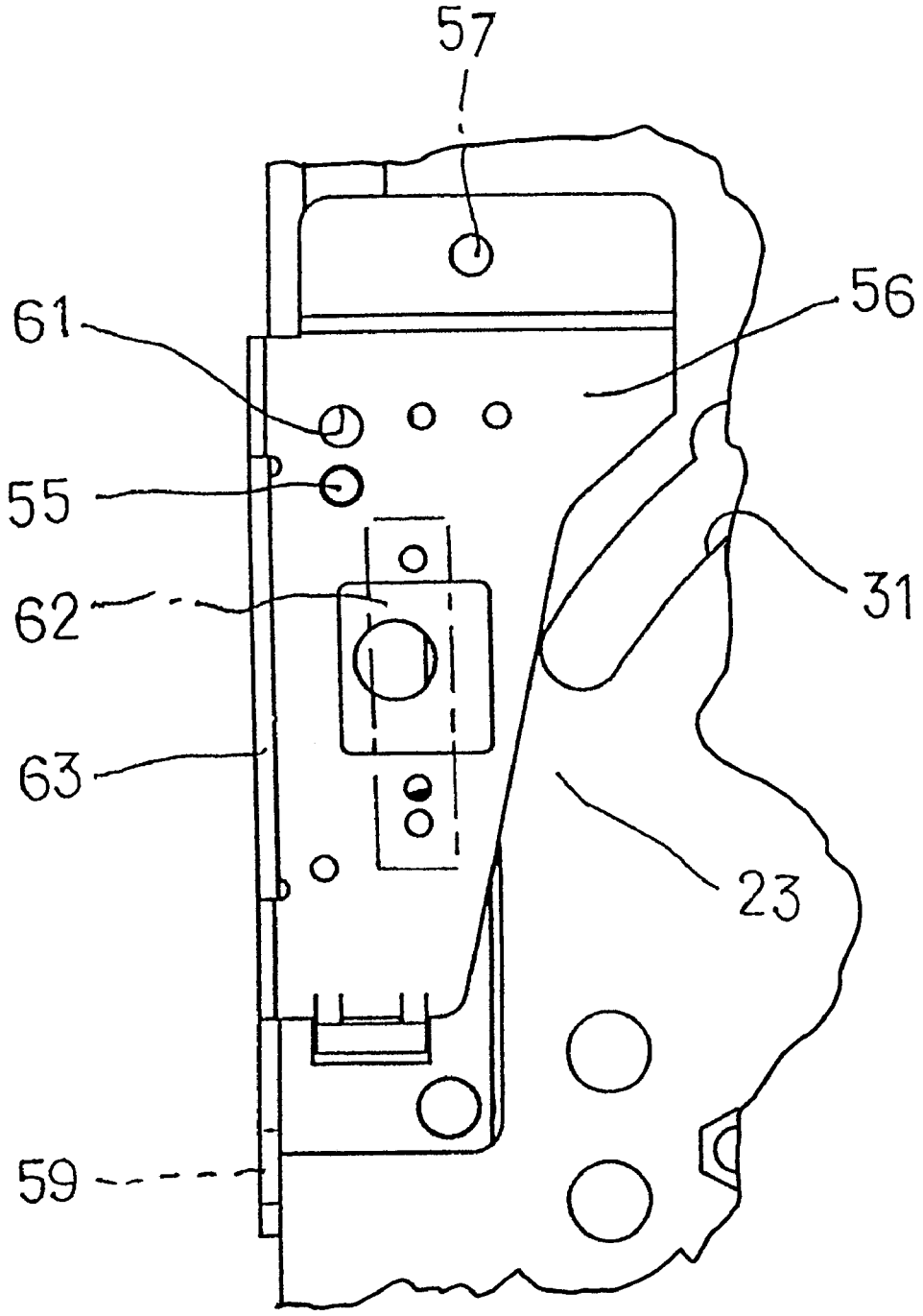
FIG. 2*a* is a partial side elevational view with a cover.
Figure 2B:
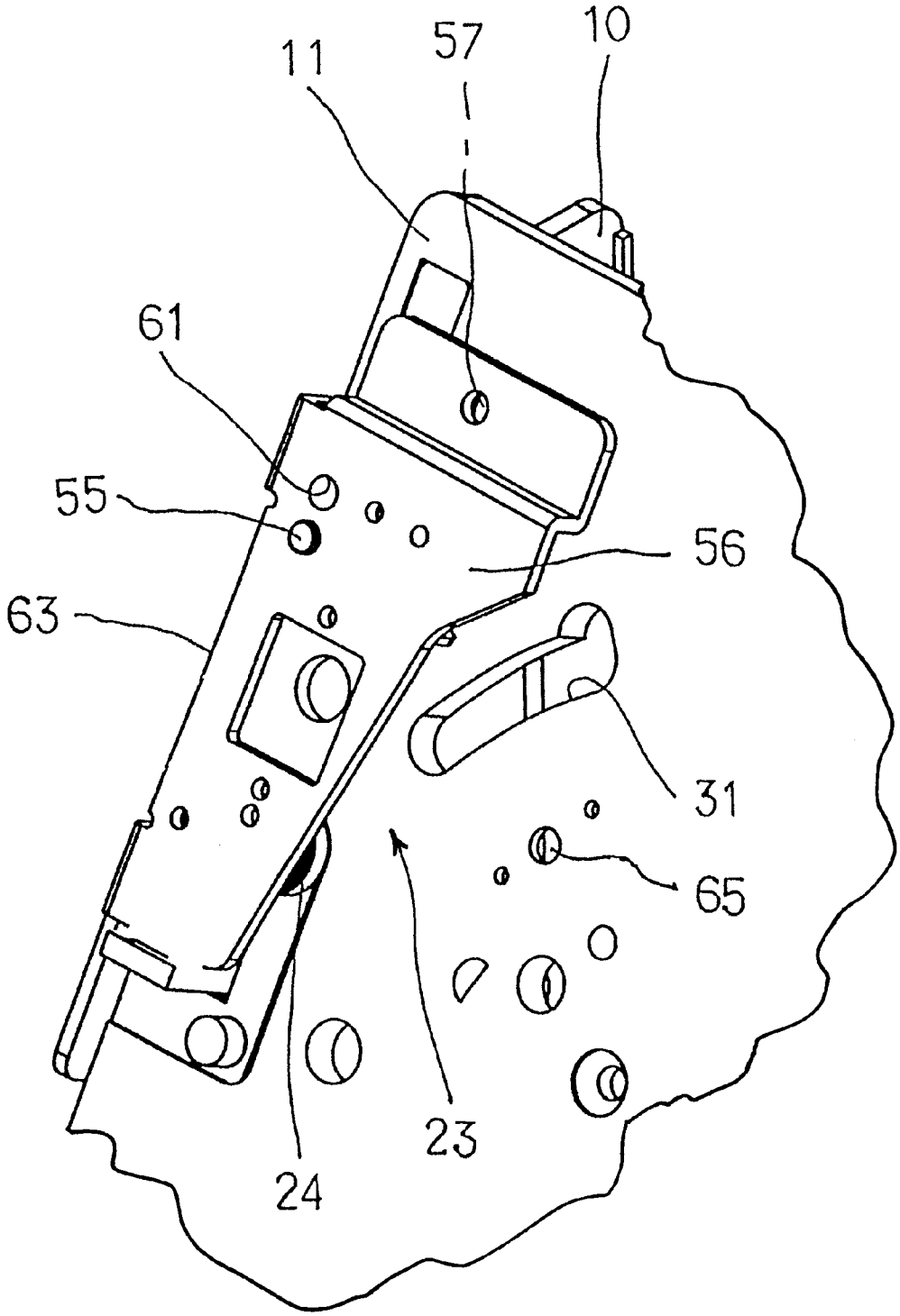
FIG. 2*b* is a partial prospective view of the cover.
Figure 3:
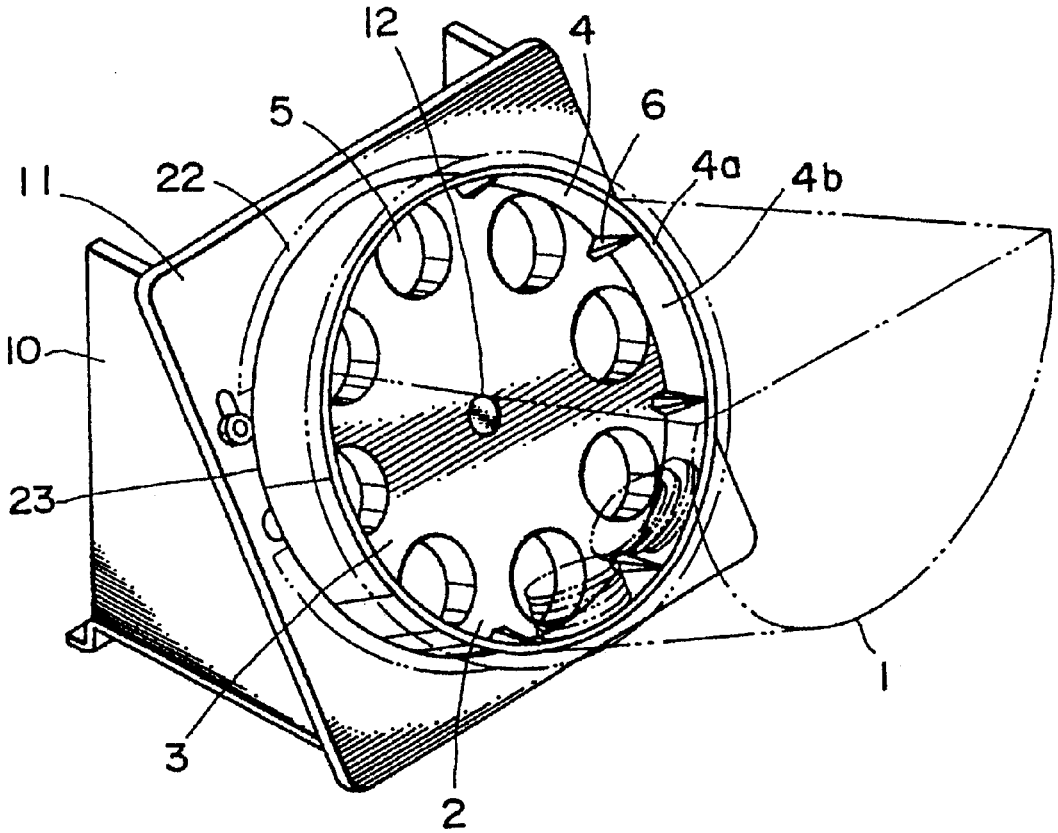
FIG. 3 PRIOR ART
FIG. 3 is a front prospective view of a prior art coin dispenser.

Referring to FIGS. 1 and 2, a coin exit portion 23 is formed at the left side of, for example, a large rectangular support plate 11 of the type generally disclosed in the prior art FIG. 3. This support plate 11 is installed to be approximately in a vertical or standing condition by virtue of a pair of triangular support frames 10. As can be seen in FIG. 1B, the coin exit 23 is framed by a pair of rollers. At the lower portion of the exit 23 is a fixed contact roller 24, while at the upper portion of the coin exit 23, a movably mounted roller 26 is installed and journaled in a camming elongated hole 31. The hole or opening 31 governs the movement of the movable roller 26 which is further biased by a spring member 66 to a passive position adjacent a lower end of the opening 31. Thus, a coin C, that is forced to pass through the exit portion 23 will displace the movable roller 26, as shown by the phantom lines in FIG. 1A.

Figure 4:
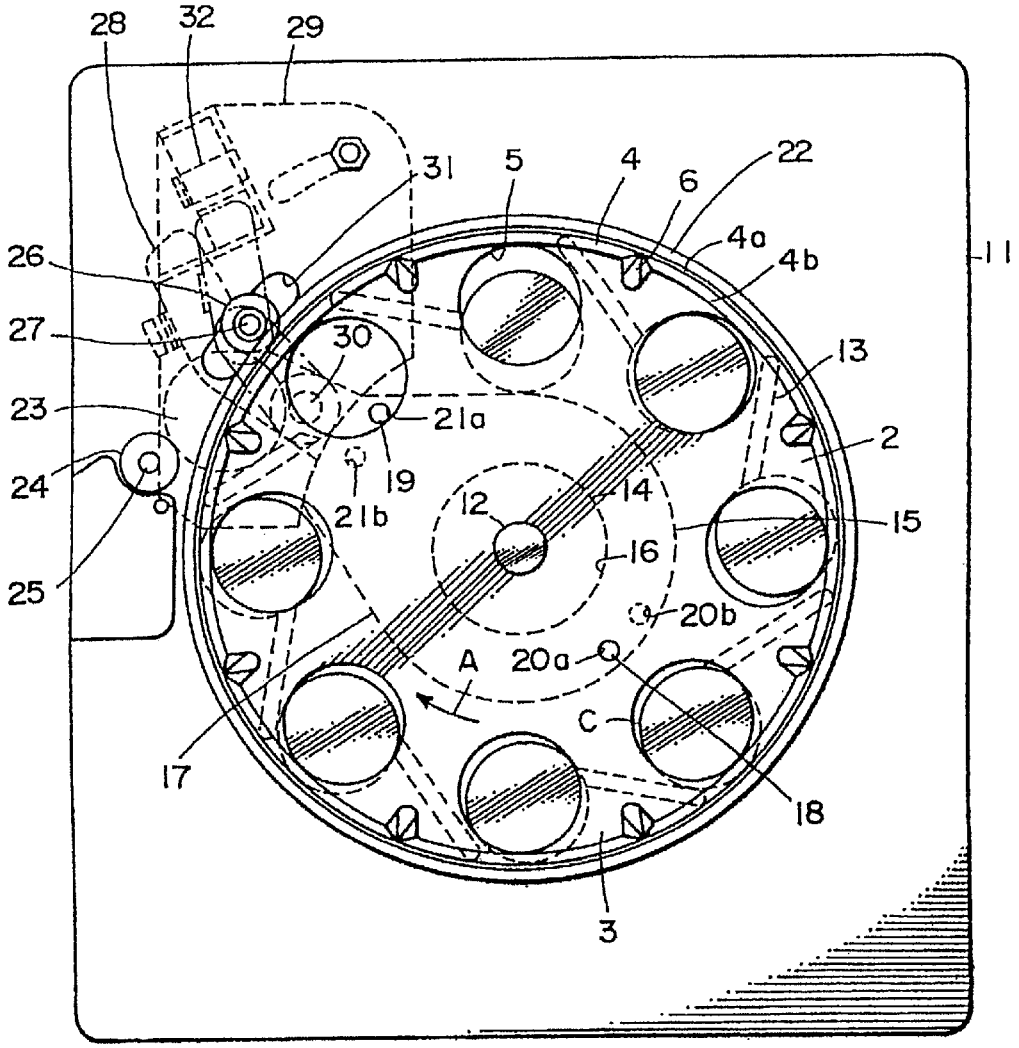
FIG. 4 PRIOR ART
FIG. 4 is a front elevational view of the prior art coin dispenser.

As can be readily understood, the mechanism for forcing the coin C, along a coin passageway from a storage hopper and through the coin exit 23 can be in accordance with conventional coin dispensing apparatus such as the structure shown in FIGS. 3 and 4. The dispensing movement of such a coin, however, is not limited to that structure and other conventional mechanisms can be utilized within the framework of the present invention.

At the coin discharge side of the exit opening 23, a diversionary wall member 51 is fixed to the support plate 11. The wall 51 has an approximately triangular entrance configuration with the underside of the diversionary or prevention wall 51 having a linear sloping surface 52. This arrangement prevents a discharged coin, particularly a discharged coin at a relatively high speed from being discharged from the support plate 11 at an uncontrolled speed and motion. Thus, the contact of the coin C with the lower slope 52 prevents the coin from continuing forward in an upward movement as shown in FIG. 1A. The sloping surface 52 is approximately traverse to the axial direction of the opening 31. A cut out portion of the diversionary or prevention wall 51 mounts a shaft 55 with a rotatable guide roller 53. The shaft 55 is mounted in the support plate 11 in such a manner that the guide roller 52 can be freely rotated about the shaft. The guide roller 53 is designed to direct the coin C, downward as it leaves contact with the slope or guide rail 52.

Referring to FIG. 2A, a cover board 56 is mounted to provide a slot coin opening in cooperation with the opposing surface of the support plate 11. As can be further seen in FIG. 2B, the cover plate 56 is bent into approximately a "L" shape in cross section with its larger upper portion directly fixed on the support plate 11 by a bolt nut 57. The lower end portion of the cover plate 56 can be further fixed on the support frame 10 by a screw 59. As shown in FIG. 2A, a slender elongated slot 63 for coin emission is formed along the bent portion of the cover plate 56. Additionally, the upper end of the shaft 55 for the guide roller 53 can be journaled within a hole in the cover plate 56 as shown in FIGS. 2A and 2B. To be able to accommodate different sized coins, an auxiliary hole 61 is used in case the diameter of the coin is larger. As can be appreciated, the positioning of the diversionary or prevention wall 51 can also be appropriately adjusted as known in the art.

When a coin is ejected through the slender slot 63, it can be appropriately counted and a sensor 62 can be positioned at the center surface of the cover board 56 for this purpose. Although the details are not disclosed in our current drawings, it should be understood that a coin regulation pin 65 can be used as an alternative to the guide plate 15 as disclosed in FIG. 4 in the practical examples of FIGS. 1 and 2.

In operation, a coin that has been stored in a loose arrangement within the hopper of the coin dispensing apparatus can be picked up and delivered, for example, by the selector mechanism disclosed in FIGS. 3 and 4 to the coin exit or aperture 23 as shown in FIGS. 1A, 1B, 2A and 2B. The coin is forced or pushed between the fixation roller 24 and the moveable roller 26. When the coin is pushed between the fixation roller 24 and the moveable roller 26, the moveable roller 26 is moved against the spring force of spring 66 as the moveable roller 26 is guided by the cam opening 31. Thus, the force generated by the ejection of the coin C is converted into stored energy in the spring 66. When the coin C is pushed further through the exit open 23, it contacts the slope 52 on the prevention wall 51 to be guided in a new direction.

The return movement of the movement roller 26 under the urging of the spring 66 can contact the back edge of the coin C and can provide a downward force to assist as the coin is then passed for contact with the rotatable guide roller 53. The coin C, in effect, is flicked to the outside in a downward movement through the ejection slot 63. As shown in FIG. 1A, the ejection direction is an oblique downward motion, when compared to the original ejection motion of the coin, as a result of this guide assembly arrangement. As can be appreciated, the fixation roller 24, the mobile roller 26 and the direction changing roller 53 have cylindrical configurations and are journaled for free rotation on their shafts. The surface of these rollers can be further formed from metal or coated with a plastic material.

In summary, by providing this particular arrangement of a coin ejection guide assembly to the ejection opening of a coin dispensing apparatus, coins can be discharged at a higher speed while controlling the direction of the discharged coins, and even a coin dispensing apparatus such as hopper equipment that is currently installed in the field can be converted in a easy manner by the addition of these features to such equipment. As can be readily appreciated, the installation of these components can be provided in a relatively compact space, thereby reducing the prior size requirements such as shown, for example, in FIG. 4.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. In a coin dispensing apparatus for dispensing a coin from a plurality of stored coins, wherein a coin is removed from storage and directed to an exit opening, the improvement of a coin ejection guide assembly comprising:

a movable member for contacting the coin adjacent the exit opening;

a spring member for biasing the movable member against passage of the coin through the exit opening;

a contact member positioned opposite the movable member at a predetermined distance for forcing the coin to push against the movable member; and a guide unit located downstream of the movable member for contacting the coin and changing the direction of movement of the coin after it has pushed against the movable member, whereby the spring member applies an ejection force through the movable member so the coin is propelled through the exit opening in the changed direction.

2. The coin ejecting guide assembly of claim 1, wherein the movable member is a roller and the contact member is a roller.

3. The coin ejection guide assembly of claim 2, wherein the guide unit includes a guide roller.

4. The coin ejection guide assembly of claim 3, wherein the guide unit includes a guide rail.

5. The coin ejection guide assembly of claim 4, wherein the guide rail includes a sloping surface that is approximately traverse in direction to a movement of the movable roller member.

6. The coin ejection guide assembly of claim 5, wherein the contact roller member and the guide roller member have fixed positions relative to the movement of the movable roller member.

7. A coin dispensing apparatus for dispensing a coin comprising:

a storage member for storing loose bulk coins;

a selection mechanism for removing individual coins from the storage member and directing the coins along a coin discharge passageway to a coin exit opening;

a movable member for contacting the coin adjacent the exit opening;

a spring member for biasing the movable member against passage of the coin through the exit opening;

a contact member positioned opposite the movable member at a predetermined distance for forcing the coin to push against the movable member; and a guide unit located downstream of the movable member for contacting the coin and changing the direction of movement of the coin after it has pushed against the movable member, whereby the spring member applies an ejection force through the movable member so the coin is propelled through the exit opening in the changed direction.

8. The coin ejecting guide assembly of claim 7, wherein the movable member is a roller and the contact member is a roller.

9. The coin ejection guide assembly of claim 8, wherein the guide unit includes a guide roller.

10. The coin ejection guide assembly of claim 9, wherein the guide unit includes a guide rail.

11. The coin ejection guide assembly of claim 10, wherein the guide rail includes a sloping surface that is approximately traverse in direction to a movement of the movable roller member.

12. The coin ejection guide assembly of claim 9, wherein the contact roller member and the guide roller member have fixed positions relative to the movement of the movable roller member.

* * * * *